US009642423B2

(12) United States Patent
Klein

(10) Patent No.: US 9,642,423 B2
(45) Date of Patent: May 9, 2017

(54) CONFIGURABLE SYSTEM FOR ORGANIZING ITEMS

(71) Applicant: Alicia Klein, Walnut Creek, CA (US)

(72) Inventor: Alicia Klein, Walnut Creek, CA (US)

( * ) Notice: Subject to any disclaimer, the term of this patent is extended or adjusted under 35 U.S.C. 154(b) by 0 days.

(21) Appl. No.: 15/059,285

(22) Filed: Mar. 2, 2016

(65) Prior Publication Data

US 2016/0255930 A1 Sep. 8, 2016

Related U.S. Application Data

(60) Provisional application No. 62/127,632, filed on Mar. 3, 2015.

(51) Int. Cl.

| | |
|---|---|
| ***B65D 33/14*** | (2006.01) |
| ***A45C 7/00*** | (2006.01) |
| ***A45C 13/10*** | (2006.01) |
| ***A45C 11/26*** | (2006.01) |

(52) U.S. Cl.

CPC ..... *A45C 7/0086* (2013.01); *A45C 7/0077* (2013.01); *A45C 11/26* (2013.01); *A45C 13/10* (2013.01); *A45C 2013/1015* (2013.01)

(58) Field of Classification Search

CPC ..... A45C 7/0086; A45C 7/0077; A45C 11/26; A45C 13/10; A45C 2013/1015

USPC ..... 383/11, 13, 22, 24, 39

See application file for complete search history.

(56) References Cited

U.S. PATENT DOCUMENTS

| | | | | |
|---|---|---|---|---|
| 3,316,669 | A | 5/1967 | Nachbar | |
| 4,072,033 | A * | 2/1978 | Eckerdt | A45C 11/32 70/456 B |
| 4,401,219 | A * | 8/1983 | Mink | A45C 7/0095 206/466 |
| 4,427,390 | A | 1/1984 | Manger | |
| 4,548,375 | A * | 10/1985 | Moss | A45F 5/02 224/665 |
| 4,561,525 | A | 12/1985 | Shidner | |
| 4,720,012 | A | 1/1988 | Dufour | |
| 4,746,009 | A * | 5/1988 | Liberman | G09F 5/02 190/16 |
| 4,848,562 | A | 7/1989 | Liu | |
| 4,848,585 | A | 7/1989 | Snyder | |
| 4,930,635 | A | 6/1990 | Hotchkiss et al. | |
| 5,125,519 | A * | 6/1992 | Cambria | A45C 7/0086 211/113 |
| 5,351,813 | A * | 10/1994 | Golovan | A45C 11/18 206/449 |
| 5,617,948 | A | 4/1997 | Rainey | |
| 5,676,482 | A | 10/1997 | Hawkins | |
| 5,706,935 | A | 1/1998 | Lorton | |
| 5,779,033 | A | 7/1998 | Roegner | |
| 5,799,791 | A | 9/1998 | Harley | |
| 5,890,587 | A | 4/1999 | Roegner | |

(Continued)

*Primary Examiner* — Jes F Pascua

(74) *Attorney, Agent, or Firm* — Steven R. Vosen

(57) ABSTRACT

A system for organizing items is described. The items are stored in pouches that can be removably placed on a fastening surface. The system includes panels that can accept the pouches and which have tabs that can also be removably attached to the panel or to another panel. The panels may thus be attached to one another to form an arbitrary long surface for organizing items. The tabs may be folded back to the panels to form loops which can support the panels. The panels also have holes for storing the panels in a binder.

15 Claims, 6 Drawing Sheets

(56) References Cited

U.S. PATENT DOCUMENTS

| | | | | |
|---|---|---|---|---|
| 6,056,549 | A | 5/2000 | Fletcher | |
| 6,113,454 | A * | 9/2000 | Mitchell | A63H 33/00 446/227 |
| 6,126,012 | A | 10/2000 | Roegner | |
| 6,161,979 | A | 12/2000 | Yamamoto et al. | |
| 6,244,400 | B1 | 6/2001 | Bowers | |
| 6,409,013 | B1 | 6/2002 | Eskandry | |
| 6,547,070 | B1 | 4/2003 | Kolpin | |
| 6,634,473 | B1 | 10/2003 | Wagner | |
| 6,715,594 | B2 | 4/2004 | Milionta et al. | |
| 7,140,643 | B1 | 11/2006 | Smith | |
| 7,331,461 | B2 | 2/2008 | MacKinnon | |
| 7,441,977 | B2 | 10/2008 | Merzon | |
| 7,731,023 | B1 | 6/2010 | Lesch | |
| 7,740,131 | B2 | 6/2010 | Marcello | |
| 2003/0006164 | A1 | 1/2003 | Mateus et al. | |
| 2004/0031655 | A1 | 2/2004 | Milionta et al. | |
| 2004/0134734 | A1 | 7/2004 | Hollingsworth | |
| 2005/0016808 | A1 | 1/2005 | Sapyta | |
| 2006/0180481 | A1 | 8/2006 | McGaughey | |
| 2006/0207697 | A1 | 9/2006 | Greiner | |
| 2007/0246389 | A1 | 10/2007 | Marcello | |
| 2009/0196536 | A1 | 8/2009 | Young | |
| 2010/0000884 | A1 | 1/2010 | Harris-Bowman | |
| 2010/0155266 | A1 | 6/2010 | Nicholson | |
| 2013/0134160 | A1 | 5/2013 | Klein | |
| 2015/0122672 | A1 * | 5/2015 | Bouton-MacLaughlin | A45C 3/00 206/216 |

* cited by examiner

CONFIGURABLE SYSTEM FOR ORGANIZING ITEMS

CROSS-REFERENCE TO RELATED APPLICATIONS

This application claims the benefit of U.S. Provisional Application No. 62/127,632, filed Mar. 3, 2015, the contents of which are hereby incorporated by reference in its entirety.

BACKGROUND OF THE INVENTION

Field of the Invention

The present invention generally relates to systems for organizing items, and more particularly to a configurable system for storing items on panels.

Discussion of the Background

Many people accumulate many items that, for various reasons, need to be organized, protected or separated from one another. Thus, for example, it is not uncommon for a person to possess many sets of earrings, necklaces, or other pieces jewelry. The earrings form matched sets that may get separated, the necklaces may get tangled with other objects, and the pieces may become damaged from contact with other pieces.

With small component parts of any variety, it is not uncommon for parts to get separated, lost and/or mixed up with other small parts, and all pieces may become damaged from contact with other pieces. Prior art solutions to the problem of organizing and sorting articles include placing individual articles in separate closable pouches or containers, and in containers with fixed compartments or individual positions for the articles, for example tackle boxes. These solutions are rather limited, as they do not permit a person to readily re-arrange, stabilize, or organize the contents of the fixed pouches or compartments for later use.

Thus there is a need in the art for an apparatus that permits a person with a great number of articles, such as jewelry, to easily view each piece and arrange or organize the articles. Such an apparatus should be portable, easy to use, and allow a user to arrange pieces at will.

BRIEF SUMMARY OF THE INVENTION

The present invention overcomes the disadvantages of prior art by providing a modular system for storing items. The system allows for items to be stored in binders or to be hung on a wall.

One embodiment provides a system for storing items comprising: one or more panels, where each panel includes a front surface and a back surface, where the front surface and the back surface have a common edge, and where the front surface and the back surface each include a first fastener material, a plurality of holes near a first portion of the edge, and two or more tabs including a first tab and a second tab, where the first tab and the second tab are flexible, and are each affixed to the panel near the first portion of the edge with a length that protrudes beyond the edge, and each include a second fastening system material that is removably attachable to the first fastener material; and one or more pouches for storing items, where each pouch of the one or more pouches includes a second fastening material that is removably attachable to the first fastener material of the front surface or the back surface of one of the one or more panels. Each tab of the two tabs is foldable to either: 1) extend away from the first portion of the edge, 2) form a loop by removably attaching to the first surface or the second surface near the first portion, or 3) removably attach the second fastener material of the tab with the first fastener material of either the front surface or the back surface of one panel of the one or more panels. Each pouch of the one or more pouches are arrangeable on any one of the one or more panels by removably affixing the second fastener material of each of the one or more pouches to the first fastener material of one of the one or more pouches.

Another embodiment provides a system for storing items comprising: two or more panels, where each panel includes a front surface and a back surface, where the front surface and the back surface have a common edge forming a rectangular shape, and where the front surface and the back surface each include a first fastener material, a plurality of holes near a first portion of the edge, and two or more tabs including a first tab and a second tab, where the first tab and the second tab are flexible, and are each affixed to the panel near the first portion of the edge with a length that protrudes beyond the edge, and includes a second fastening system material that is removably attachable to the first fastener material; a multi-ring binder having rings spaced to accept the plurality of holes of the one or more panels; and one or more pouches for storing items, where each pouch of the one or more pouches includes a second fastening material that is removably attachable to the first fastener material of the front surface or the back surface of one of the two or more panels. Each tab of the two tabs is foldable to either: 1) extend away from the first portion of the edge, 2) form a loop by removably attaching to the first surface or the second surface near the first portion, or 3) removably attach the second fastener material of the tab with the first fastener material of either the front surface or the back surface of one panel of the of the one or more panels. Each pouch of the one or more pouches is arrangeable on any one of the two or more panels by removably affixing the second fastener material of each of the one or more pouches to the first fastener material of one of the one or more pouches.

These features together with the various ancillary provisions and features which will become apparent to those skilled in the art from the following detailed description, are attained by the panels of the present invention, preferred embodiments thereof being shown with reference to the accompanying drawings, by way of example only, wherein:

Reference symbols are used in the Figures to indicate certain components, aspects or features shown therein, with reference symbols common to more than one Figure indicating like components, aspects or features shown therein.

DETAILED DESCRIPTION OF THE INVENTION

Embodiments are described for the organizing of items stored in pouches, which can be removably attached to surfaces of panels. The present invention has great flexibility in arrangement of the panels, such as by attaching them to other panels using tabs attached to the panels to provide a larger area for arranging items, for supporting the panels from loops formed from the tabs or from holes in the panels, and for storing the panels in a binder or carrying case.

Examples of items which may be organized in the present invention include, but are not limited to, articles of finished jewelry, jewelry making parts, small component parts for other hobbies such as scrapbooking, fishing, stamp collecting, sewing, fine detail model building, large scale board games, and so on. Additionally, hobbyists often enjoy the company of other like-minded hobbyists and so need to be able conveniently find the necessary component parts for any given project and collect sets of component parts in one receptacle in order to transport them when meeting with fellow hobby enthusiasts.

Figure 1A:
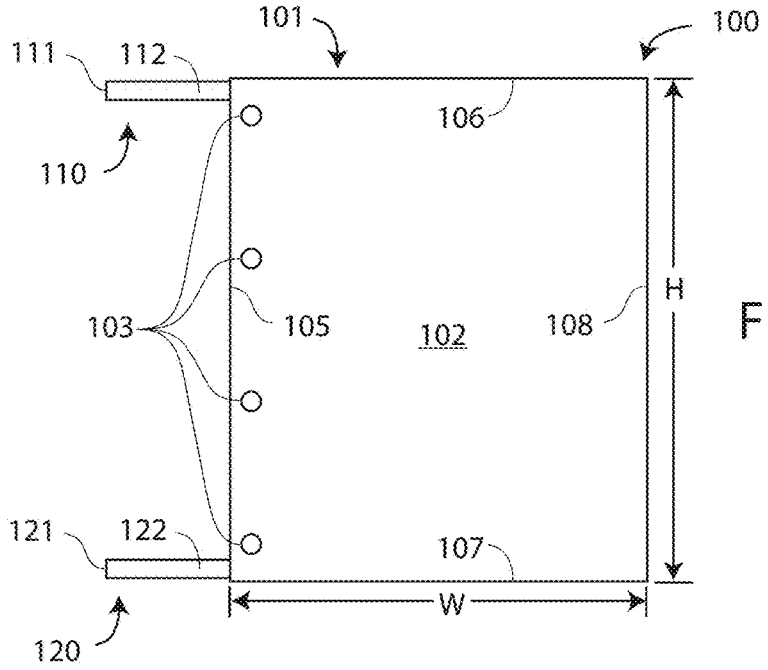
FIG. 1A is a front view of one embodiment of a tabbed panel for storing items.
Figure 1B:
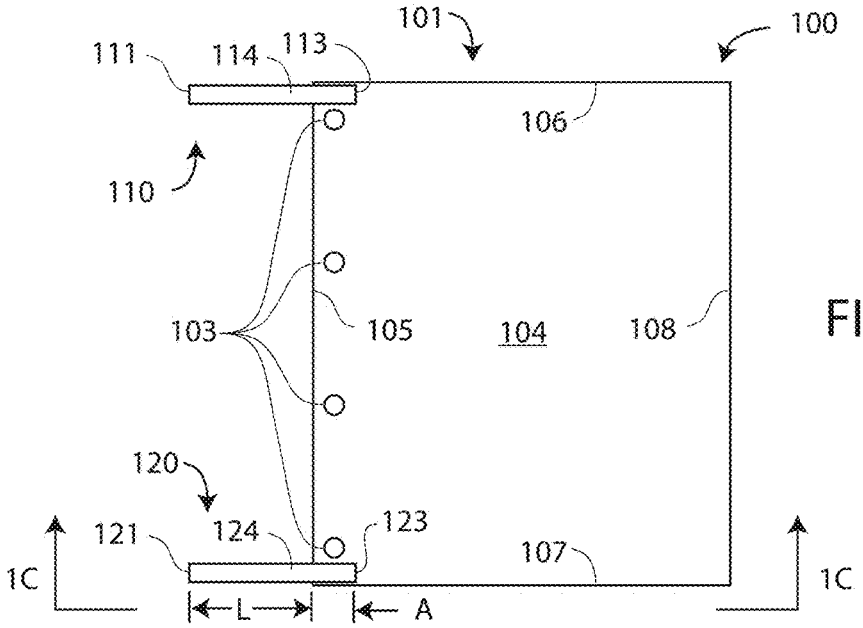
FIG. 1B is a back view of the tabbed panel of FIG. 1A.
Figure 1C:
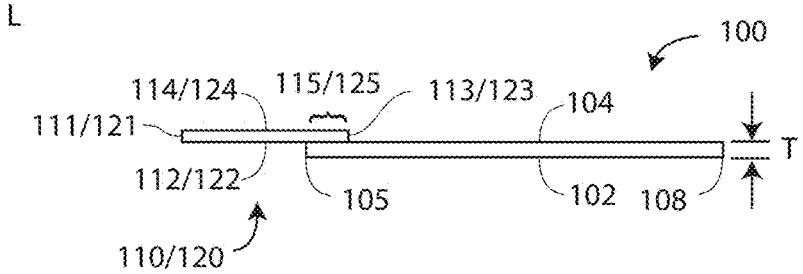
FIG. 1C is a side view of the tabbed panel of FIG. 1A.

One embodiment of a tabbed panel 100 of a configurable system for storing items is shown in the front view of FIG. 1A, the back view of FIG. 1B, and the side view of FIG. 1C, as indicated in FIG. 1B.

Tabbed panel 100 includes a panel 101, a first tab 110 and a second tab 120. Panel 101 has a front surface 102 and an opposing back surface 104 that define a first edge 105, a second edge 106, a third edge 107 and a fourth edge 108. Panel 101 also includes holes 103 which are located near first edge 105, and which may be reinforced, for example, with grommets. First tab 110 and second tab 120 are both located near first edge 105, with the first tab near second edge 106 and the third tab near third edge 107, respectively generally similar to each other and are attached to panel 101. Tabs 110/120 are generally similar to each other and have a front surface 112/122 and a back surface 114/124, an end 113/123 that is attached near edge 105, and free ends 111/121. Tabs 110/120 have a corresponding portion 115/125 of length A that is attached to panel 101 and free ends 111/121 that both extend a distance L from first edge 105.

In alternative embodiments, tabbed panel 100 may include only one tab or more than two tabs along first edge 105, and/or one or more tabs along one of the other edges, such as along second edge 106, third edge 107, and/or fourth edge 108. In another alternative embodiment, the portions 115/125 of length A is between front surface 102 and back surface 104, and the length L protrudes from the edge.

In one embodiment, surfaces 102 and 104 are one part of a fastening system and surfaces 112 and 122 are matching parts of the fastening system. Thus, for example and without limitation, the fastening system may be a hook and loop fastener system, such as VELCRO®, surfaces 112 and 122 including hooks, and surfaces 102 and 104 including loops, felt, or nap material that can be restrained by the hook surfaces. Surfaces 112/122 of tabs 110/120 may, as described subsequently, be attached to surfaces 102 or 104 of tabbed panel 100, or to the surfaces 102 or 104 of another, similarly constructed component.

Figure 2A:
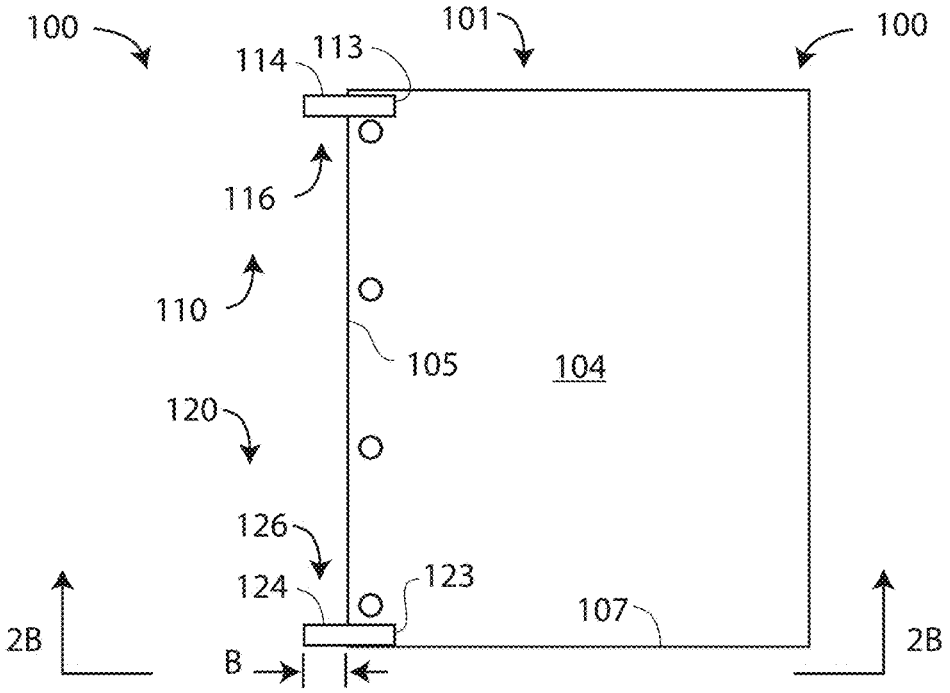
FIG. 2A is a back view of the tabbed panel of FIG. 1A, where the tabs are folded back onto the panel.
Figure 2B:
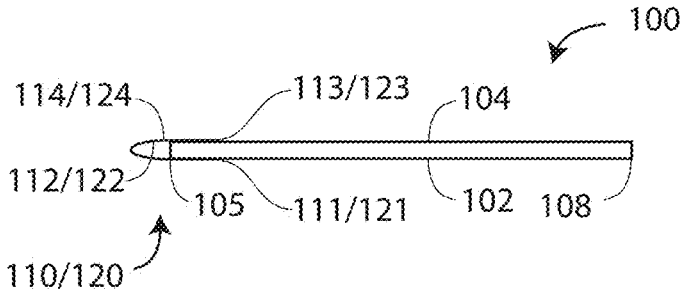
FIG. 2B is a side view of the tabbed panel of FIG. 2A.

FIG. 2A is the back view of tabbed panel 100, where tabs 110 and 120 are folded back onto panel 101, and FIG. 2B is a side view of the tabbed panel of FIG. 2A. Specifically, surfaces 112/122 of tabs 110/120 are both shown fastened to surface 102 of panel 101 to form loops 116/126, respectively. Loops 116/126 protrude some distance from first edge 105, indicated as length B. The value of B may vary from zero to slightly less than L/2, depending on how much of surface 112/122 is placed on surface 104.

The dimensions of panel 101 include a width W, a height H, and a thickness T. In one embodiment, panels 101 are sided to fit within a loose-leaf binder, and may, for example have a width W of 8.5 inches and a height H of 11 inches and a thickness T of ⅛ inch. Other sizes for W, H, and T include, but are not limited to: 8.5 inches×5 inches×⅛ inches, and 4 inches×8 inches×⅛ inches.

The internal structure of panel 101 may, in certain embodiments, be rectangular cardboard or plastic sheets covered by sheets of a VELCRO® loop material, including but not limited to, chipboard, cork board, or a sub-material consisting of synthetic compositions.

Figure 2C:
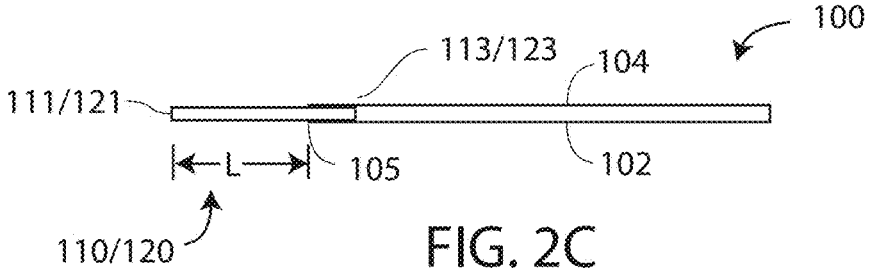
FIG. 2C is a side view an alternative embodiment of the tabbed panel of FIG. 2A.

Tabs 110 and 120 may be, for example and without limitation, VELCRO® hook material strips, where L is 2.5 inches, 3 inches, 3.5 inches or 4 inches, and are fastened over a length A to panel 101 by stitching or with an adhesive. FIG. 2C is a side view an alternative embodiment of the tabbed panel of FIG. 2A, showing a part of tabs 110/120 attached between surfaces 102 and 104 and protruding from edge 105.

In general, panel 101 includes one or more holes 103, which may located at any position on the panel. In certain embodiments, the one or more holes 103 are positioned near first edge 105, and may include 1, 2, 3, 4, or more holes, which may be reinforced with grommets. In another embodiment, holes 103 they may be arranged along second edge 106, third edge 107 or fourth edge 108, or along more than one edge.

Figure 3A:
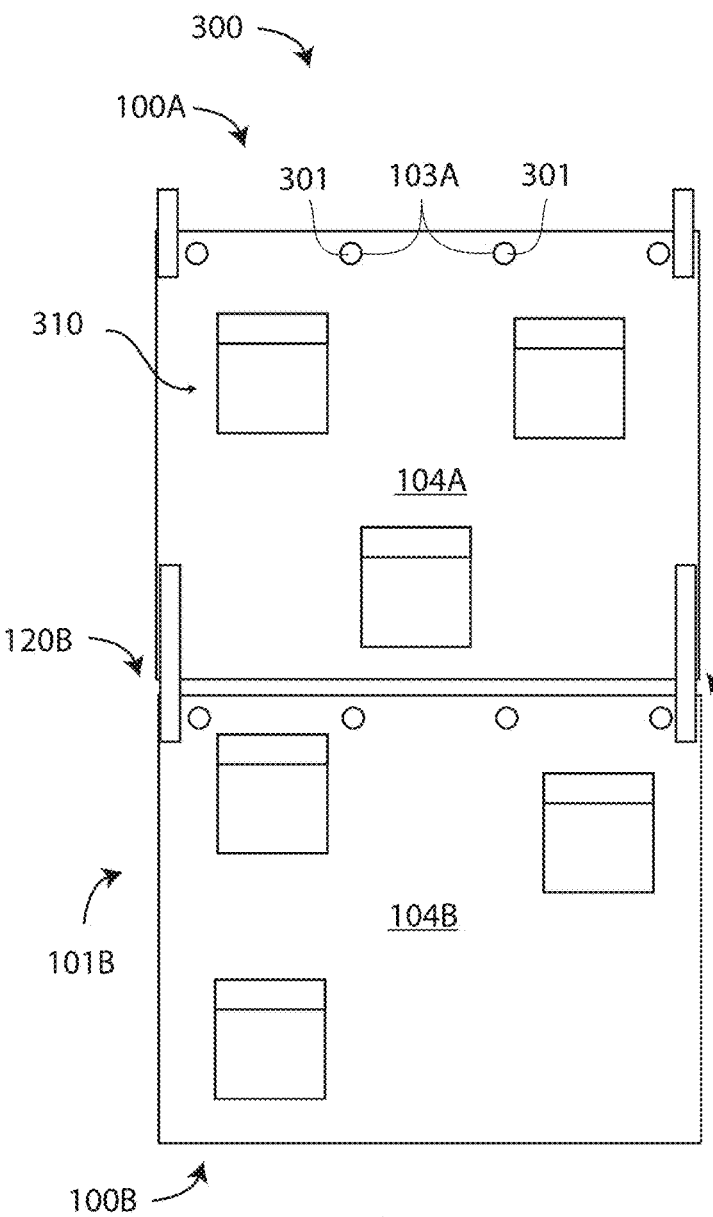
FIG. 3A is a front view of a configuration of two tabbed panels of FIG. 1A in a storage system.
Figure 3B:
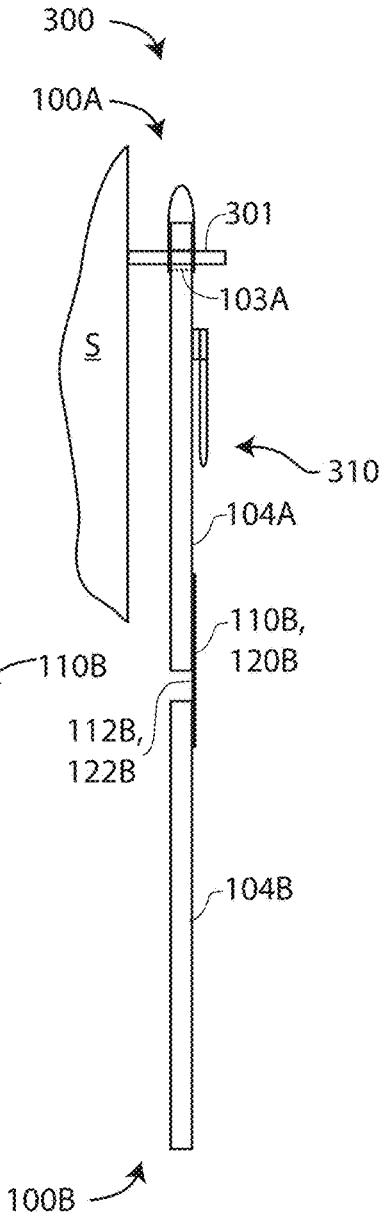
FIG. 3B is a side view of the configuration of FIG. 3A.

FIG. 3A is the front view and FIG. 3B is a side view of a configuration of an upper tabbed panel 100A and a lower tabbed panel 100B in a storage system 300. Each of tabbed panels 100A and 100B is generally similar to tabbed panel 100, surfaces 104A and 104B are generally similar to back surface 104, holes 103A are generally similar to holes 103, and tabs 110B and 120B are generally similar to tabs 110 and 120.

As shown in FIGS. 3A and 3B, tabs 110B and 120B of lower tabbed panel 100B may be extended and affixed to rear surface 104A of upper tabbed panel 100A. As shown in FIG. 3B, a peg 301 extending from a wall S support storage system 300 by holes 103A of the upper tabbed panel. Tabs 110 and 120 of upper panel 100B are not used to support storage system 300, and may in the configuration shown in FIGS. 1A or FIG. 2A.

Since front surface 102 and back surface 104 are both covered with the same type of fastener (the loops of the hook and loop fastener system), panels 100A and 100B may be reversed and be configured in essentially the same configuration as storage system 300. Further, storage system 300 may be extended by attaching an additional panel, similar to panel 100, below lower panel 100A. The length of storage system 300 may be extended to an arbitrary number of panels by attaching tabs of one panel to surface of an adjacent panel.

Figure 4A:
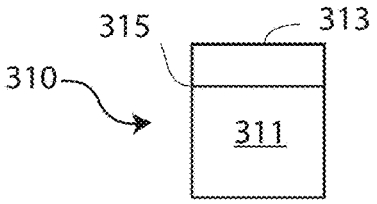
FIG. 4A is a front view of a pouch for use with the tabbed panel.
Figure 4B:
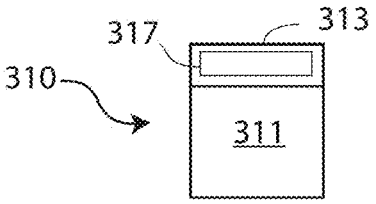
FIG. 4B is a back view of the pouch of FIG. 4A.

FIGS. 4A and 4B are a front view and a back view, respectively, of a pouch 310 for use with the tabbed panel 100. Pouches 310 include, preferably, clear plastic pouches 311 having an opening 313 and a resealable closure 315, such as ZIPLOC®, and a length of an attachment material 317, such as a hook fabric to match loops of surfaces 102 and 104, for attaching the pouches to the surfaces of panels 100. Surfaces 102 and/or 104 may thus support a number of user arranged pouches 310. The storage systems of the present invention may include a number of pouches 310, which may be the same size or of a selection of sizes to allow a user to organize the pouches on the various surface.

Figure 5A:
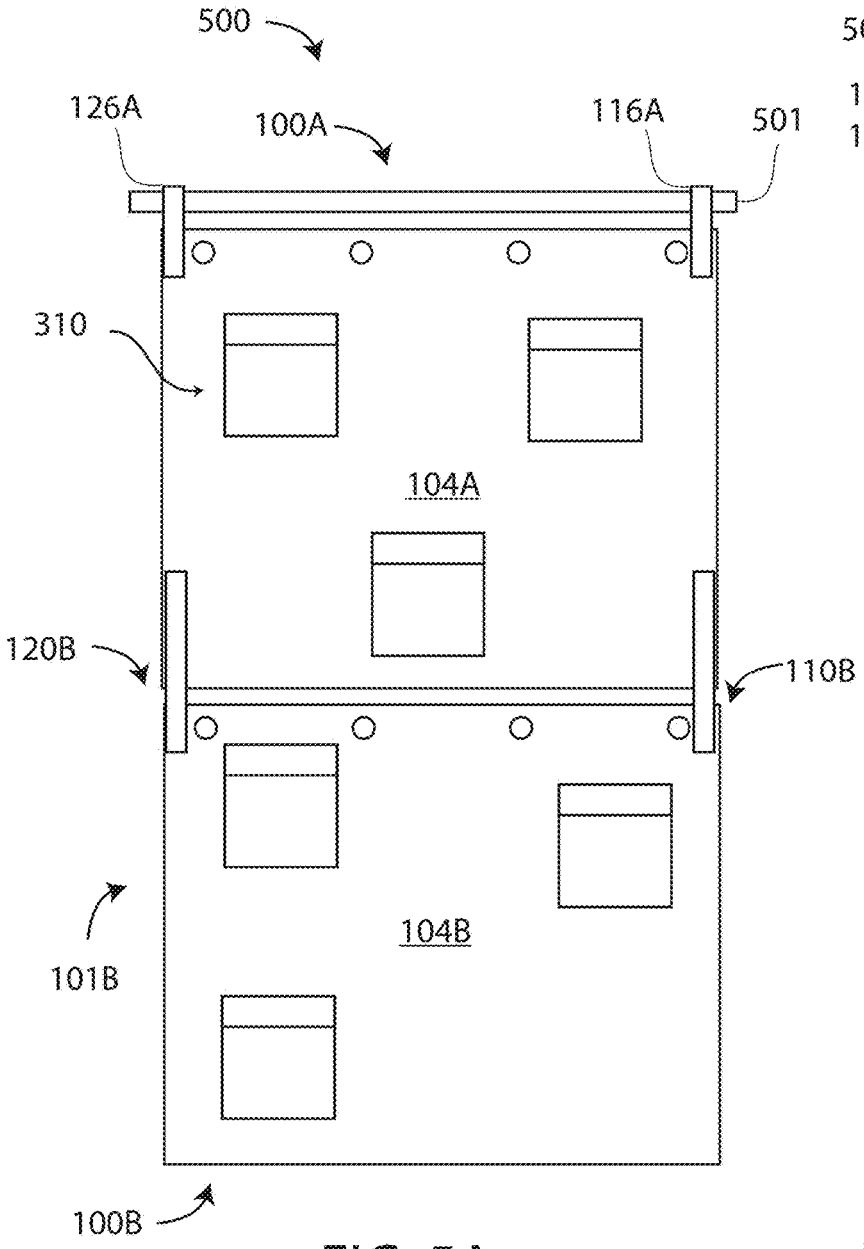
FIG. 5A is a front view of an alternative configuration of two tabbed panels of FIG. 1A in a storage system.
Figure 5B:
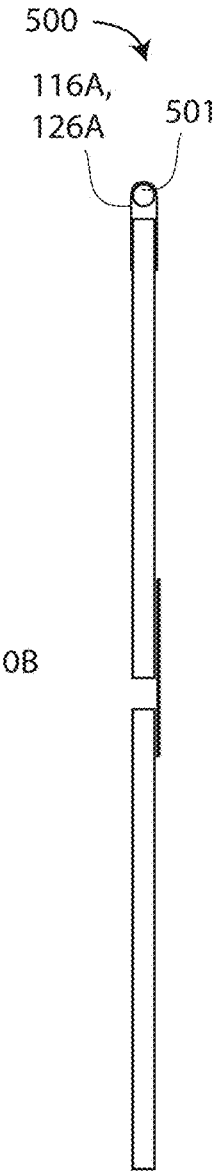
FIG. 5B is a side view of the configuration of FIG. 5A.

FIG. 5A is the front view and FIG. 5B is a side view of a configuration of an upper tabbed panel 100A and a lower tabbed panel 100B in a storage system 500. Storage system 500 is generally similar to storage system 300, except as discussed subsequently.

As shown in FIGS. 5A and 5B, tabs 110A and 120A are folded over to form loops 116A and 126A, as shown in FIGS. 2A and 2B. Storage system 500 is supported by loops 116A and 126B from a horizontal rod 501. Horizontal rod 501 may, for example, protrude from a wall, or be a horizontal element of a clothes hanger, which may, in turn, be supported by a knob, a rod or from the top of a door or panel.

Each of tabbed panels 100A and 100B is generally similar to tabbed panel 100, surfaces 104A and 104B are generally similar to back surface 104, holes 103A are generally similar to holes 103, and tabs 110B and 120B are generally similar to tabs 110 and 120.

Figure 6A:
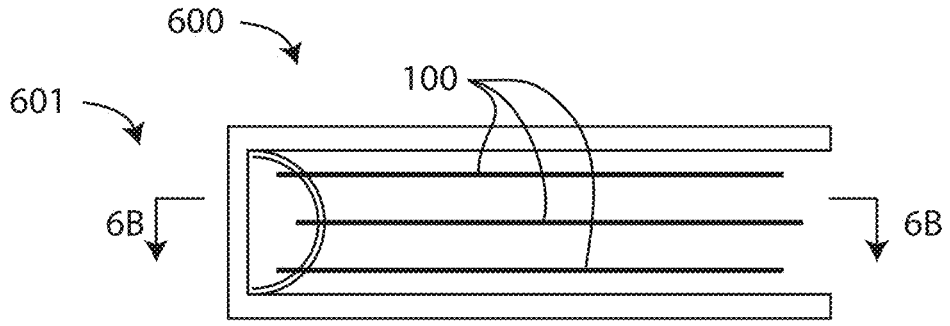
FIG. 6A is a side view of another an alternative configuration of a storage system.
Figure 6B:
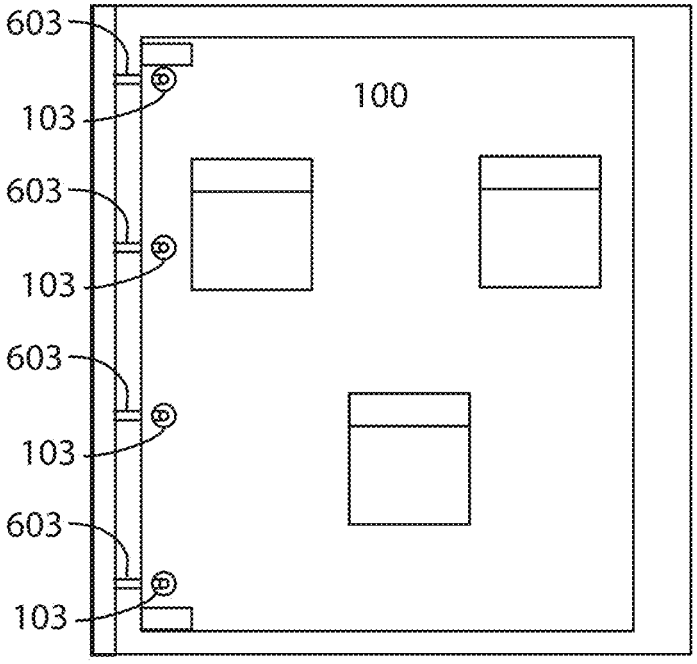
FIG. 6B is a front view of the storage system of FIG. 6A.

FIGS. 6A and 6B are a side and front view, respectively, of alternative configuration of a storage system 600. Storage system 600 is includes a binder 601 and one or more tabbed panels 100 which may support one or more pouches 310. Binder 601 includes several rings 604 which can be opened and closed, and which can accept holes 103 of binders 100.

Figure 7A:
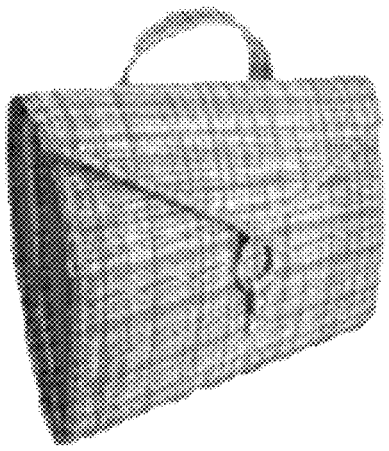
FIG. 7A is a perspective view of yet another alternative configuration of a storage system in a closed configuration.
Figure 7B:
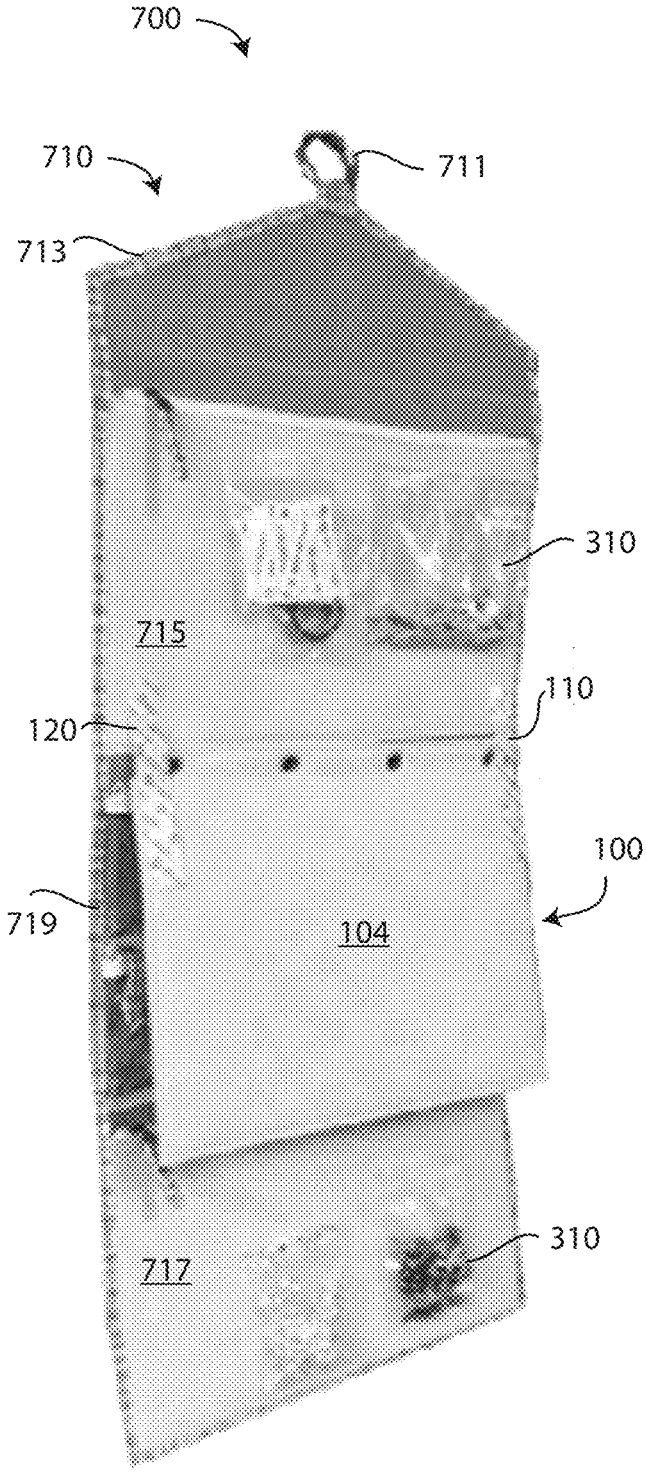
FIG. 7B is a perspective view of the system of FIG. 7A in an open configuration.

FIG. 7A is a perspective view of yet another alternative configuration of a storage system 700 in a closed configuration; and FIG. 7B is a perspective view of the system of FIG. 7A in an open configuration. Storage system 700 includes a carrying case 710 and a tabbed panel 100. As shown in FIG. 7B, carrying case 710 includes a sheet of fabric 713 with a ring 711 at one end, a first surface 715 and a second surface 717 both including loops of a hook and loop fastening system, and built in pockets 719. The hooks of the hook and loop fastening system on tabs 110 and/or 120 of tabbed panel 100 may be removably attached to the loops of the hook and loop fastening system of either one of first surface 715 or 717. FIG. 7B shows tabs 110 and 120 extended and attached to surface 715. Pouches 310 can be placed, as shown, on surfaces 715 or 717, or on surface 104.

Carrying case 710 may be folded, as in FIG. 7A, or opened as in FIG. 7B, where ring 711 may be used to support the case. Storage system 700 may include one tabbed panel 100 placed on surface 715, as shown in FIG. 7B, or on surface 717. Alternatively, carrying case 710 may support one tabbed panel on surface 715 and a second tabbed panel on surface 717. In another alterative embodiment, surface 715 or 717 may support a first tabbed panel that supports additional tabbed panels, as described above with reference to storage system 300.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention.

I claim:

1. A system for storing items comprising:

one or more panels, where each panel includes a front surface and a back surface, where said front surface and said back surface have a common edge, and where said front surface and said back surface each include a first fastener material, a plurality of holes near a first portion of said edge, and two or more tabs including a first tab and a second tab, where said first tab and said second tab are flexible, and are each affixed to the panel near said first portion of said edge with a length that protrudes beyond said edge, and each include a second fastening system material that is removably attachable to said first fastener material; and one or more pouches for storing items, where each pouch of said one or more pouches includes a second fastening material that is removably attachable to said first fastener material of said front surface or said back surface of one of said one or more panels, such that each tab of said two tabs is foldable to either: 1) extend away from said first portion of said edge, 2) form a loop by removably attaching to said first surface or said second surface near said first portion, or 3) removably attach said second fastener material of said tab with said first fastener material of either said front surface or said back surface of one panel of said one or more panels, and such that each pouch of said one or more pouches is arrangeable on any one of said one or more panels by removably affixing said second fastener material of each of said one or more pouches to said first fastener material of one of said one or more pouches.

2. The system for storing items of claim 1, where said first fastener material is a loop material of a hook and loop fastener system, a felt material, or a nap material, and where said second fastener material is a hook material of said hook and loop fastener system.

3. The system for storing items of claim 1, where said edge of said one or more panels has a rectangular shape, and where said first portion of said edge is one side of said rectangular shape.

4. The system for storing items of claim 3, further including a multi-ring binder having rings spaced to accept said plurality of holes of said one or more panels.

5. The system for storing items of claim 1, where said one or more panels includes a first panel and a second panel, where either said front surface of said first panel or said back surface of said first panel is removably affixed to said first tab of said second panel and said second tab of said second panel.

6. The system for storing items of claim 5, where said first panel and said second panel are supported from a location at or near said first portion of said first panel.

7. The system for storing items of claim 6, where said first panel and said second panel are supported by a supporting element placed through one or more holes of said plurality of holes of said first panel.

8. The system for storing items of claim 6, where said first tab forms a first loop near said first edge of said first panel, where said second tab forms a second loop near said first edge of said first panel, and where said first panel and said second panel are supported by a supporting element placed through said first loop and said second loop of said first panel.

9. The system for storing items of claim 1, further including a carrying case including a surface comprising a first fastener material, and where said first fastener material of said surface of said carrying case is removably affixed to said second fastener material of said first tab and said second tab of said one or more panels.

10. A system for storing items comprising:

two or more panels, where each panel includes a front surface and a back surface, where said front surface and said back surface have a common edge forming a rectangular shape, and where said front surface and said back surface each include a first fastener material, a plurality of holes near a first portion of said edge, and two or more tabs including a first tab and a second tab, where said first tab and said second tab are flexible, and are each affixed to the panel near said first portion of said edge with a length that protrudes beyond said edge, and includes a second fastening system material that is removably attachable to said first fastener material;

a multi-ring binder having rings spaced to accept said plurality of holes of said one or more panels; and one or more pouches for storing items, where each pouch of said one or more pouches includes a second fastening material that is removably attachable to said first fastener material of said front surface or said back surface of one of said two or more panels, such that each tab of said two tabs is foldable to either: 1) extend away from said first portion of said edge, 2) form a loop by removably attaching to said first surface or said second surface near said first portion, or 3) removably attach said second fastener material of said tab with said first fastener material of either said front surface or said back surface of one panel of said of said one or more panels, and such that each pouch of said one or more pouches is arrangeable on any one of said two or more panels by removably affixing said second fastener material of each of said one or more pouches to said first fastener material of one of said one or more pouches.

11. The system for storing items of claim 10, where said first fastener material is a loop material of a hook and loop fastener system, a felt material, or a nap material, and where said second fastener material is a hook material of said hook and loop fastener system.

12. The system for storing items of claim 10, where said two or more panels includes a first panel and a second panel, where either said front surface of said first panel or said back surface of said first panel is removably affixed to said first tab of said second panel and said second tab of said second panel.

13. The system for storing items of claim 12, where said first panel and said second panel are supported from a location at or near said first portion of said first panel.

14. The system for storing items of claim 13, where said first panel and said second panel are supported by a supporting element placed through one or more holes of said plurality of holes of said first panel.

15. The system for storing items of claim 13, where said first tab forms a first loop near said first edge of said first panel, where said second tab forms a second loop near said first edge of said first panel, and where said first panel and said second panel are supported by a supporting element placed through said first loop and said second loop of said first panel.

* * * * *